US010196839B2

(12) United States Patent
Cencer

(10) Patent No.: US 10,196,839 B2
(45) Date of Patent: Feb. 5, 2019

(54) APPARATUS AND METHOD FOR SECURING RAILCAR DOORS

(71) Applicant: Trinity North American Freight Car, Inc., Dallas, TX (US)

(72) Inventor: Robert J. Cencer, Tipton, MI (US)

(73) Assignee: Trinity North American Freight Car, Inc., Dallas, TX (US)

( * ) Notice: Subject to any disclaimer, the term of this patent is extended or adjusted under 35 U.S.C. 154(b) by 102 days.

(21) Appl. No.: 15/415,081

(22) Filed: Jan. 25, 2017

(65) Prior Publication Data

US 2018/0209184 A1 Jul. 26, 2018

(51) Int. Cl.

| | |
|---|---|
| ***E05B 39/02*** | (2006.01) |
| ***E05B 83/02*** | (2014.01) |
| ***E05B 35/00*** | (2006.01) |
| ***E05B 67/38*** | (2006.01) |
| ***B61D 19/00*** | (2006.01) |

(52) U.S. Cl.

CPC ..... *E05B 83/02* (2013.01); *B61D 19/001* (2013.01); *E05B 35/008* (2013.01); *E05B 67/383* (2013.01)

(58) Field of Classification Search

CPC ..... E05B 83/02; E05B 35/008; E05B 67/383; B61D 19/001

USPC ..... 70/2–12, 211, 212; 292/211

See application file for complete search history.

(56) References Cited

U.S. PATENT DOCUMENTS

| | | | | | |
|---|---|---|---|---|---|
| 901,419 | A * | 10/1908 | Carlson | E05C 19/14 | 292/106 |
| 1,406,095 | A * | 2/1922 | Zygmunt | E05B 83/02 | 70/455 |
| 1,813,240 | A * | 7/1931 | Joseph | E05B 17/183 | 292/281 |
| 2,571,349 | A * | 10/1951 | Noble | B60D 1/60 | 280/434 |
| 3,317,230 | A * | 5/1967 | Demrick | E05C 19/08 | 292/281 |
| 4,113,291 | A * | 9/1978 | Cameron | E05B 67/383 | 174/50 |
| 4,322,102 | A * | 3/1982 | Lindblom | E05C 19/08 | 292/281 |
| 4,581,907 | A * | 4/1986 | Eberly | E05B 67/38 | 292/205 |
| 4,793,163 | A * | 12/1988 | MacFarlane | E05C 19/08 | 16/374 |
| 5,131,246 | A * | 7/1992 | Bonzer | B62D 43/007 | 292/113 |

(Continued)

*Primary Examiner* — Jerry E Redman

(74) *Attorney, Agent, or Firm* — Baker Botts, LLP

(57) ABSTRACT

According to some embodiments, an apparatus for securing railcar doors comprises a staple affixed to a portion of a railcar. The staple defines a staple hole. The apparatus further comprises a hasp. The hasp comprises a hinge. The hasp further comprises a first portion pivotally coupled to the hinge. The first portion is affixed to the railcar. The hasp further comprises a second portion. The second portion comprises a first end and a second end. The first end of the second portion is pivotally coupled to the hinge. The second end is opposite the first end. The second portion of the hasp comprises a square key plug configured to be inserted into a square key hole of a railcar door. The second portion of the hasp defines a first hole through which a portion of the staple may pass when the hasp is in a closed position.

20 Claims, 6 Drawing Sheets

(56) References Cited

U.S. PATENT DOCUMENTS

| | | | | | |
|---|---|---|---|---|---|
| 5,456,506 | A * | 10/1995 | Bartlett | E05C 19/08 | 16/223 |
| 5,667,261 | A * | 9/1997 | Weinerman | E05C 19/14 | 292/113 |
| 6,053,547 | A * | 4/2000 | Lemieux | E05B 65/0894 | 292/281 |
| 6,058,745 | A * | 5/2000 | Sanchez | E05B 67/38 | 70/417 |
| 6,179,350 | B1 * | 1/2001 | Ely | E05C 19/14 | 292/113 |
| 6,439,008 | B1 * | 8/2002 | Keil | B60D 1/60 | 70/54 |
| 8,266,932 | B2 * | 9/2012 | Longwell | E05B 67/383 | 70/2 |
| 8,273,984 | B2 * | 9/2012 | Combs | E05B 67/383 | 174/50 |
| 2004/0031297 | A1 * | 2/2004 | Winland | E05B 67/38 | 70/2 |
| 2008/0029529 | A1 * | 2/2008 | Ruhl | B65D 90/008 | 220/890 |

* cited by examiner

APPARATUS AND METHOD FOR SECURING RAILCAR DOORS

TECHNICAL FIELD

This disclosure generally relates to railcars, and more particularly to securing square key holes on railcar doors, such as end doors on auto racks, for example.

BACKGROUND

Railcars are integral to the transportation of goods across the country. Railcars come in many configurations depending on their intended cargo. For example, railcars can be configured to carry automobiles. Such railcars, also known as auto racks, may be the target of thefts. Certain security measures have been developed to protect railcars from unauthorized entry. The main measure used to secure railcars is a latch between the doors on the railcar, which is secured by a locking mechanism, such as a bolt seal or padlock. The latch may deter thieves and other persons from accessing the cargo. For example, a latch and bolt seal combination requires the removal of the bolt seal before moving the latch in order to open the doors. The added step of removing the locking mechanism, which may require specialized tools, may increase the time for detecting unauthorized individuals, deterring persons from attempting to access the cargo.

In order to protect cargo, such as automobiles in auto racks, additional security measures have been proposed. These include additional means to prevent the doors or other access points of the railcar from opening by holding the doors or other access points together or closed against another part of the rail car.

SUMMARY OF THE INVENTION

Particular embodiments described herein include an apparatus for securing railcar doors, such as end doors on auto racks. According to some embodiments, an apparatus for securing railcar doors comprises a staple affixed to a portion of a railcar. The staple defines a staple hole. The apparatus further comprises a hasp. The hasp comprises a hinge. The hasp further comprises a first portion pivotally coupled to the hinge. The first portion is affixed to the railcar. The hasp further comprises a second portion. The second portion comprises a first end and a second end. The first end of the second portion is pivotally coupled to the hinge. The second end of the second portion is opposite the first end. The second portion of the hasp comprises a square key plug configured to be inserted into a square key hole of a railcar door. The second portion of the hasp defines a first hole through which a portion of the staple may pass when the hasp is in a closed position.

In particular embodiments, the apparatus may further comprise a locking mechanism configured to be placed through the defined staple hole when the hasp is in the closed position to prevent the hasp from opening. In some embodiments, the locking mechanism is one of a bolt seal and a padlock.

In particular embodiments, the staple and the first portion of the hasp are welded to a portion of a railcar.

In particular embodiments, the second portion of the hasp defines the first hole between the first end of the second portion of the hasp and the square key plug.

In particular embodiments, the second portion of the hasp defines the first hole between the square key plug and the second end of the second portion of the hasp.

In particular embodiments, the apparatus further comprises a second staple. The second portion of the hasp defines a second hole through which a portion of the second staple may pass when the hasp in in a closed position. In some embodiments, the second portion of the hasp defines the first hole between the first end of the second portion of the hasp and the square key plug, and the second portion of the hasp defines the second hole between the square key plug and the second end of the second portion of the hasp.

In another embodiment, the disclosure includes a method for securing railcar doors comprising affixing a staple to a portion of a railcar. The method further comprises providing a square key plug configured to be inserted into a square key hole of the railcar. The method further comprises providing a hasp. The hasp comprises a hinge. The hasp further comprises a first portion pivotally coupled to the hinge. The hasp further comprises a second portion. The second portion comprising a first end pivotally coupled to the hinge and a second end. The second portion of the hasp defines a first hole through which a portion of the staple may be disposed. The provided square key plug is affixed to the second portion of the hasp. The method further comprises affixing the first portion of the hasp to the railcar such that when the hasp is closed, the square key plug is inserted within the square key hole of the railcar and a portion of the staple is disposed through the first hole defined in the second portion of the hasp.

In particular embodiments, the first portion of the hasp is affixed to the railcar above the square key hole of the railcar.

In particular embodiments, affixing the staple and the first portion of the hasp comprises welding each of the staple and the first portion of the hasp to a portion of the railcar.

In particular embodiments, the square key plug is affixed to the second portion of the hasp between the second end of the second portion of the hasp and the hole defined by the second portion of the hasp.

In particular embodiments, the square key plug is affixed to the second portion of the hasp between the first end of the second portion of the hasp and the hole defined by the second portion of the hasp.

In particular embodiments, the method further comprises affixing a second staple to a portion of a railcar. The second portion of the hasp defines a second hole through which a portion of the second staple may pass when the hasp in in a closed position. In some embodiments, the square key plug is affixed to a portion of the second portion of the hasp between the first hole and the second hole.

In another embodiment, the disclosure includes an apparatus that comprises at least one railcar door. The at least one railcar door comprises a locking mechanism. The locking mechanism comprises a square key hole. The locking mechanism is coupled to at least one locking pin. The apparatus further comprises a staple affixed to a portion of the at least one railcar door. The staple defines a staple hole. The apparatus further comprises a hasp. The hasp comprises a hinge. The hasp further comprises a first portion pivotally coupled to the hinge. The first portion is affixed to the railcar. The hasp further comprises a second portion. The second portion comprises a first end and a second end. The first end of the second portion is pivotally coupled to the hinge. The second end of the second portion is opposite the first end. The second portion of the hasp comprises a square key plug configured to be inserted into the square key hole of the at least one railcar door. The second portion of the hasp defines a first hole through which a portion of the staple may pass when the hasp is in a closed position.

In particular embodiments, the apparatus further comprises a locking mechanism configured to be placed through the defined staple hole when the hasp is in the closed position to prevent the hasp from opening. In some embodiments, the locking mechanism is one of a bolt seal and a padlock.

In particular embodiments, the staple and the first portion of the hasp are welded to portions of the at least one railcar door.

In particular embodiments, the second portion of the hasp defines the hole between the first end of the second portion of the hasp and the square key plug.

As a result, particular embodiments of the present disclosure may provide numerous technical advantages. The hasp in the closed position may prevent the engagement of the square key hole, preventing the doors of the railcars from being opened. Newly constructed railcars may include staple and hasps or existing railcars with square key holes may be retrofitted with staples and hasps to prevent unauthorized access to the interior of the railcars. The staples and hasps may prevent the engagement of the square key hole when in the closed position secured with a locking mechanism, such as a bolt seal or padlock.

In particular embodiments, the hasp may be affixed to a portion of the railcar such that the hasp may close, plugging the square key hole, due to the force of gravity. In such cases, when the locking mechanism is removed from the staple and hasp, the hasp does not unintentionally fall open. In some embodiments, the staple and hasp may be affixed in another orientation according to the requirements of the operators or installers. For example, the railcar to be secured may have a square key hole in a position such that the hasp may only be oriented in a limited number directions. As another example, the railcar may only have certain portions suitable to affix the staple and/or hasp, requiring a particular orientation or one of a few limited orientations.

In particular embodiments, the hasp may have more than one hole corresponding to more than one staple. According to those embodiments, the security may be increased by having a second hole and a second staple through which a second locking mechanism may be disposed holding the hasp in the closed position. Including an additional locking mechanism may increase the time required for an unauthorized person to open the hasp to gain access to the square key hole.

In particular embodiments, the square key plug inserted into the square key hole when the hasp is in the closed position may prevent the engagement of square key hole from both the exterior and interior of the railcar. The square key plug may prevent the rotation of the square key hole since the hasp, to which the square key plug is attached, cannot rotate and is held in the closed position by a locking mechanism. Thus, even a person who may gain access to the interior of the railcar may still be prevented from unloading any cargo in the railcar since the hasp would prevent the engagement of the square key hole.

Particular embodiments of the present disclosure may provide some, none, all, or additional technical advantages.

BRIEF DESCRIPTION OF THE DRAWINGS

A more complete and thorough understanding of the particular embodiments and advantages thereof may be acquired by referring to the following description taken in conjunction with the accompanying drawings, in which like reference numbers indicate like features, and wherein.

DETAILED DESCRIPTION

Particular embodiments include an apparatus for securing railcar doors, including end doors on auto racks. The safety and integrity of cargo shipped in railcars is important for both the shipping and receiving parties to ensure goods make it to their destination on time and in good condition. Unauthorized access to cargo on railcars disrupts the normal course of business, requiring time consuming investigations and the replacement of any missing or damaged goods.

Operators have typically secured the railcar access points, such as the end doors, by providing a latch between those end doors which prevent the doors from opening. The latch is usually secured with a locking mechanism, such as a bolt seal or pad lock. The latch between doors does not prevent a person from engaging the square key hole which will unlock the end doors. Thus, regardless whether a person is able to defeat the locking mechanism, he will be able to unlock the end doors, which may increase the vulnerability of the railcar cargo to theft or tampering since the square key hole is accessible to any person outside the railcar.

Particular embodiments increase the security of railcar doors while avoiding the problems described above and include an apparatus for securing railcar doors. An apparatus for securing railcar doors, such as end doors on auto racks. According to some embodiments, an apparatus for securing railcar doors comprises a staple affixed to a portion of a railcar. The staple defines a staple hole. The apparatus further comprises a hasp. The hasp comprises a hinge. The hasp further comprises a first portion pivotally coupled to the hinge. The first portion is affixed to the railcar. The hasp further comprises a second portion. The second portion comprises a first end and a second end. The first end of the second portion is pivotally coupled to the hinge. The second end of the second portion is opposite the first end. The second portion of the hasp comprises a square key plug configured to be inserted into a square key hole of a railcar door. The second portion of the hasp defines a first hole through which a portion of the staple may pass when the hasp is in a closed position. Particular embodiments of the invention and its advantages are best understood by reference to FIGS. 1 through 8, wherein like reference numbers indicate like features.

Figure 1:
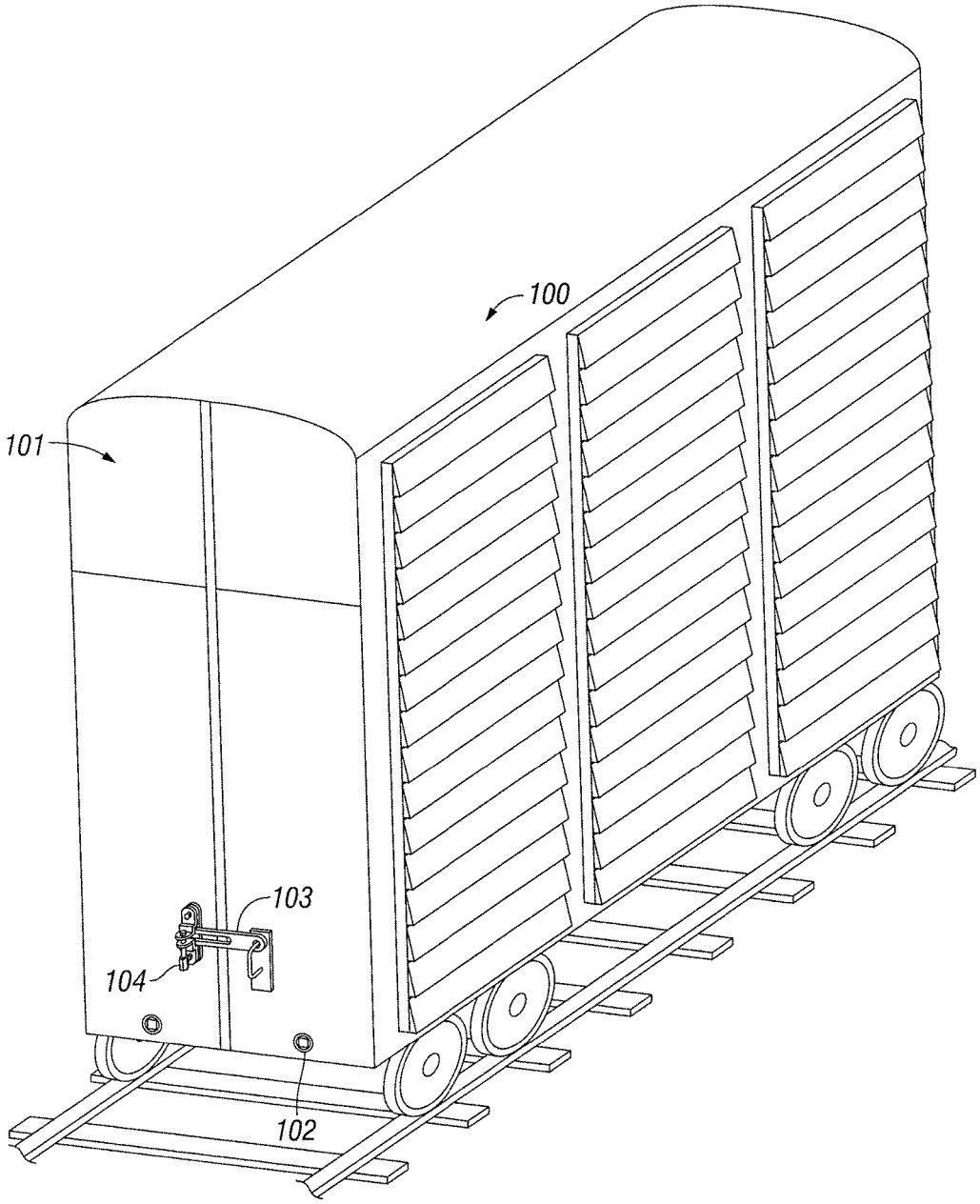
FIG. 1 is a schematic drawing of an example railcar in perspective view, according to some embodiments.

FIG. 1 is a schematic drawing of an example railcar in perspective view, according to some embodiments. Railcar 100 may carry cargo or other goods, such as automobiles. Railcar 100 comprises at least one cargo access point, for example, the doors 101 on the railcar 100. The doors 101 may open by swinging on a hinge or sliding along a track. An operator must first engage a square key hole 102 to allow the doors 101 to be opened. As illustrated, the railcar 100 has two end doors 101. Although a particular type of railcar is illustrated, other embodiments may include any type of railcar with at least one square key hole. Particular embodiments may include railcars with only one access point, for example a single railcar door. Other embodiments may include railcars with more than two access points requiring the engagement of at least one square key hole.

As illustrated, each of the doors 101 has a separate square key hole 102 that may be engaged to allow the doors 101 to be opened. In particular embodiments, there may only be one square key hole 102 for multiple access points which may be opened to provide access into the railcar. In such embodiments, engaging the square key hole 102 may allow the opening of the multiple access points.

The railcar 100 may also include a security mechanism to prevent access to the interior of the railcar by securing the railcar doors 101 together. The railcar 100 may include a latch 103 between the doors 101 that is fastened by a locking mechanism 104. The latch 103 fastened by a locking mechanism 104 prevents the doors 101 from opening even if the square key hole 102 is engaged. The locking mechanism 104 may be any suitable restraint or fastener operable to be used in combination with a latch or hasp or other mechanism used to hold access points of railcars closed. In some embodiments, the latch 103 is secured by a locking mechanism including one of a bolt seal or a padlock.

In particular embodiments, the railcar has only one door or access point. In such embodiments, the latch 103 may be mounted between the one door or access point and another part of the railcar 100 to prevent the one end door from opening when fastened with a locking mechanism. In other embodiments, there may be a plurality of latches or similar restraints and respective fasteners which prevent the opening of access points into the interior of the railcar 100 even if the square key hole 102 is engaged.

Figure 2A:
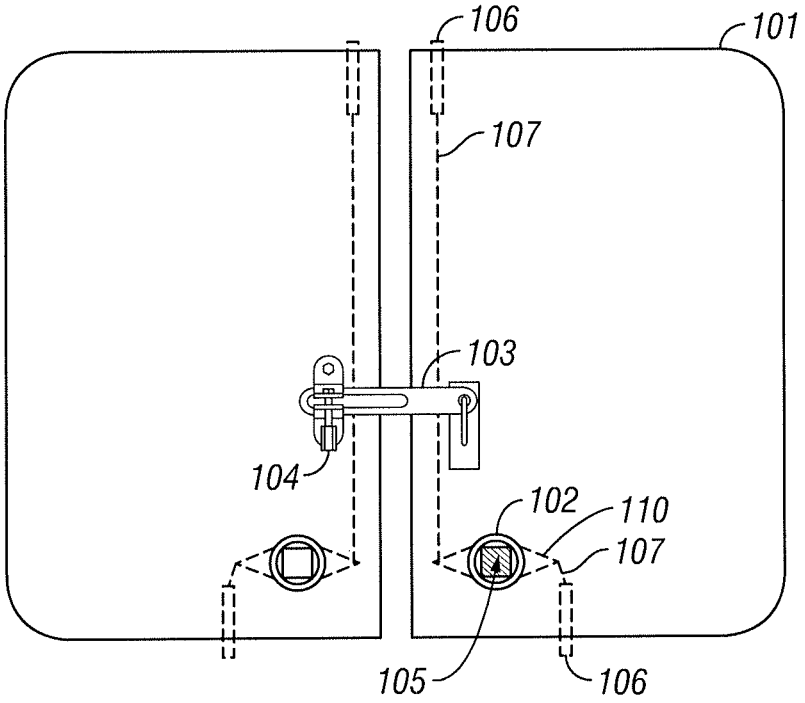
FIG. 2A is a schematic drawing in front elevation showing an end view of an example railcar and its doors, according to some embodiments.

FIG. 2A is a schematic drawing in front elevation showing an end view of an example railcar and its doors, according to some embodiments. The doors 101 may comprise a square key hole 102 coupled to a turning member 110. The turning member 110 is operable to turn when the square key hole 102 is engaged. The end doors 101 may further include locking pins 106 coupled to the turning member 110 by connectors 107. The locking pins 106 operate to secure the doors 101 in place in at least a closed position. In the illustrated embodiment the square key hole 102 is coupled to two locking pins 106 at the top and bottom of one of the doors 101. In particular embodiments, there may only be one locking pin 106. In other embodiments, there may be more than two locking pins 106. In particular embodiments, a single square key hole 102 may be engaged to unlock more than one door of a railcar 100.

Figure 2B:
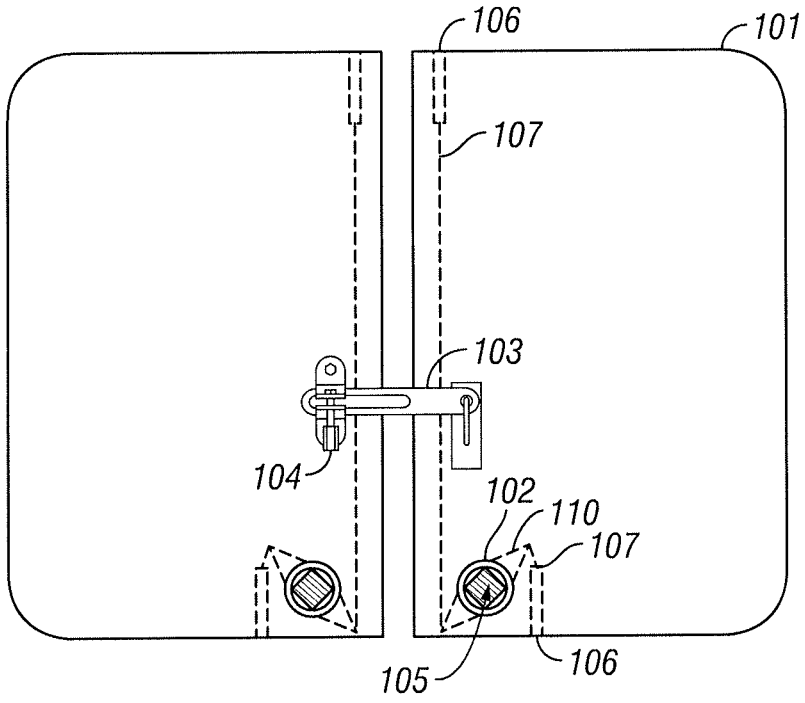
FIG. 2B is a schematic drawing of FIG. 2A in a particular mode of operation, according to some embodiments.

FIG. 2B is a schematic drawing of FIG. 2A in a particular mode of operation, according to some embodiments. The square key hole 102 may be engaged, causing the rotation of the square key hole 102, and thereby, rotating the turning member 110. When the square key hole 102 is engaged, the turning member 110 rotates and operates to move the connectors 107 such that the locking pins 106 are disengaged, allowing the end doors 101 to be opened. In particular embodiments, the square key hole 102 is coupled to the locking pins 106 directly. In other embodiments, the locking pins 106 are engaged by a different mechanism coupled to the rotation of the square key hole 102.

The illustrated embodiment of the locking mechanism coupled to the square key hole 102 is merely one example of a locking mechanism used in railcar doors. Any suitable railcar door locking mechanism that may be coupled to a square key hole would be appreciated by one of ordinary skill in the art upon viewing this disclosure.

Figure 3A:
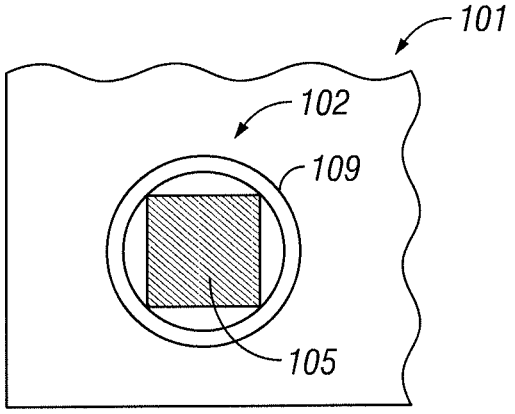
FIG. 3A is a schematic drawing in front elevation of an example square key hole of a rail car end door, according to some embodiments.

FIG. 3A is a schematic drawing in front elevation of an example square key hole of a rail car end door, according to some embodiments. The square key hole 102 is disposed within the doors 101. The square key hole 102 defines a square recess 105 in which an object may be inserted in order to engage the square key hole 102. The square recess 105 may have a substantially square cross-section. The square recess 105 may be defined to have various depths within the square key hole 102, such that in some embodiments, the square recess 105 is defined to be a cube or a rectangular prism.

In some embodiments, the square key hole includes a lip 109. The lip 109 may prevent debris or other objects from entering the square recess 105 inadvertently. One having ordinary skill in the art, in viewing this disclosure, would appreciate that in particular embodiments, the square key hole 102 may comprise other coverings or flaps to prevent the entry of debris into the square recess 105.

Figure 3B:
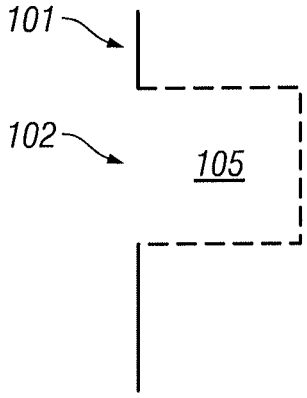
FIG. 3B is an cross-section side view of the square key hole of FIG. 3A, according to a some embodiments.

FIG. 3B is a cross-section side view of the square key hole of FIG. 3A, according to some embodiments. FIG. 3B depicts a side-on view of the square recess 105 formed within the square key hole 102 within the end doors 101. In particular embodiments, the entire square recess 105 is disposed within the doors 101. In other embodiments, only a portion of the square recess 105 is disposed within the interior of the doors 101. In particular embodiments, the square recess 105 may be defined by the square key hole 102 which extends a distance away from the doors 101.

Figure 4:
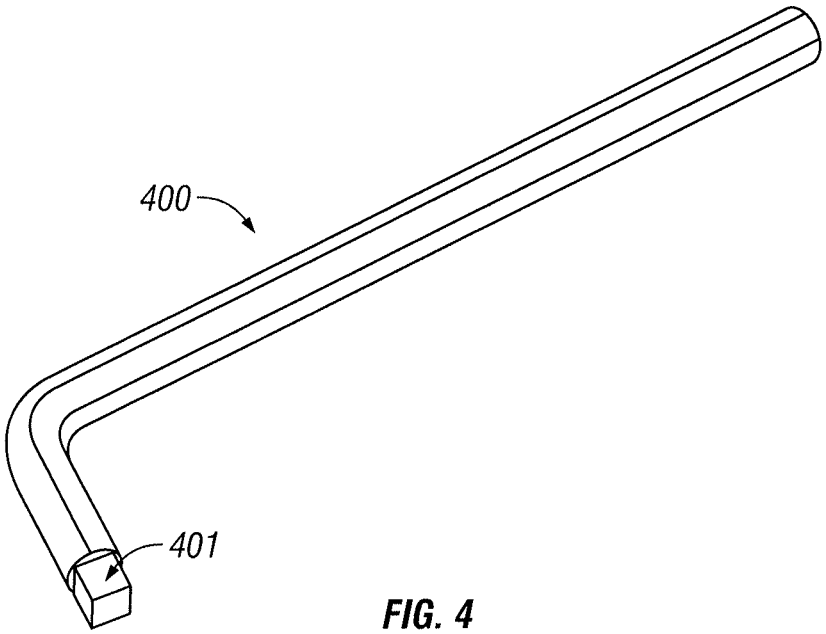
FIG. 4 is a schematic drawing in perspective view of an example square key, according to a particular embodiment.

FIG. 4 is a schematic drawing in perspective view of an example square key, according to a particular embodiment. The square key 400 includes a square head 401 and a handle 402. The square head 401 is proportioned to be inserted into the square recess 105. The square key 400 operates to engage the square key hole 102. The square head 401 is inserted into the square recess 105 such that it when the square key 400 is turned, the square head 401 transfers a torsional force to the square key hole 102, thereby engaging the square key hole 102. The handle 402 may be an elongated member allowing for a linear force to be translated into a torsional force in order to engage the square key hole 102. In particular embodiments, the square key may be a square bit attached to a driving mechanism providing a torsional force to the square bit. In other embodiments, the square key handle 402 may take a form in order to allow for better grip within a human hand operating the square key 400 to engage the square key hole 102.

Figure 5A:
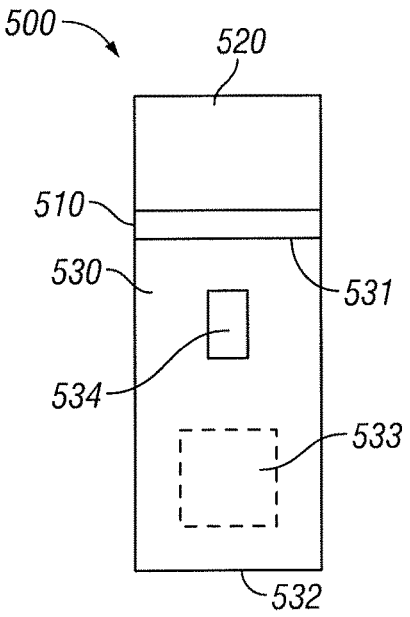
FIGS. 5A-5C are schematic drawings of an example hasp and staple for securing a square key hole, according to a particular embodiment.
Figure 5B:
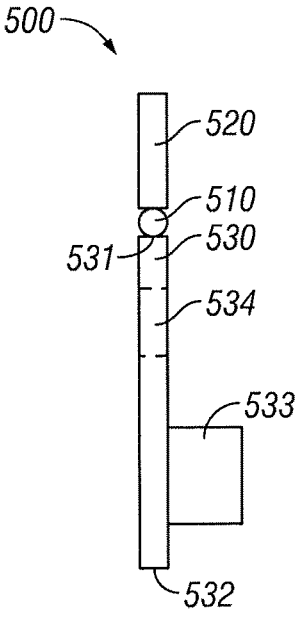

FIGS. 5A and 5B are schematic drawings, in front elevation and in cross section side view, respectively, of an example hasp, according to some embodiments. The hasp 500 may comprise a hinge 510, a first portion 520, and a second portion 530. The first portion 520 may be pivotally coupled to the hinge 510. The second portion 530 may comprise a first end 531 and a second end 532. The first end 531 of the second portion 530 may be pivotally coupled to the hinge 510. The second end 532 of the second portion 530 may be opposite the first end 531 of the second portion 530.

The hinge 510 of the hasp 500 may be any suitable hinge device allowing the articulation of one or more coupled elements about an axis about the hinge 510. In particular embodiments, the hinge 510 may be a jointed device comprising more than one component and separate components pivotally coupled to each of the first portion 520 and the second portion 530 of the hasp 500. In other embodiments the hinge 510 may comprise a single flexible component coupled to both the first portion 520 and the second portion 530 of the hasp 500. In some embodiments, the hinge 510 may be formed, at least partially, from portions from at least one of the first portion 520 and the second portion 530 of the hasp 500.

In some embodiments, the first portion 520 may be affixed to a portion of a railcar 100. Affixing the first portion 520 may allow the hasp 500 to be secured to the railcar 100 such that an unauthorized person may not easily remove the hasp 500. The first portion 520 may be affixed by a number of fastening means, including, but not limited to, welding, riveting, gluing, cementing, crimping, and securing by a bolt and nut. For example, the first portion 520 of the hasp 500 may be welded to a portion of an end door 101 of a railcar 100.

The second portion 530 may articulate around an axis of the hinge 510. The hinge 510 may allow the second portion 530 to be rotated towards and away from the railcar 100 after the first portion 520 is affixed to a portion of the railcar 100. In some embodiments, the hinge 510, after the first portion 520 is affixed, may allow the second portion 530 to be rotated around the hinge 510 axis up to an angle of 180 degrees. In some embodiments, the second portion 530 may only rotate up to 90 degrees or less away from the railcar 100.

In some embodiments, the second portion 530 of the hasp 500 may define a first hole 534. The first hole 534 may be defined to allow a portion of the railcar 100 or a portion of an object affixed to the railcar 100 to pass through the first hole 534 when the second portion 530 is disposed against the railcar 100. For example, the first hole 534 may be defined to allow an affixed staple 540 to pass through the second portion 530. The first hole 534 may be defined to be a suitable size and shape to permit the staple 540 to pass through the second portion 530 as the second portion 530 articulates around the axis of the hinge 510 towards the railcar 100.

According to some embodiments, the first hole 534 is rectangular with the hole's longer side aligned in the direction between the first end 531 and the second end 532. In other embodiments, the first hole 534 may be rectangular but aligned such that the hole's short side is in the direction between the first end 531 and the second end 532. In other embodiments, the first hole 534 may be non-rectangular. For example, the first hole 534 may be defined to have rounded edges, or to have a circular or oval shape. The first hole 534 may be defined in any suitable shape or size to allow the affixed staple 540 to be disposed through the first hole 534.

In particular embodiments, the first hole 534 may be defined to be larger than a particular staple in order to accommodate a variety of staple sizes and shapes that may be used on a railcar. For example, an installer may want to use different types of staples for different applications, such as using different locking mechanisms to secure the hasp 500 in the closed position. In that example, there may be only one type of hasp 500 installed which may accommodate the variety of staple sizes and shapes. In other embodiments, the first hole 534 is defined such that it corresponds to a specific staple such that the shape and size of the first hole 534 correspond to the shape and size of the staple 540.

According to some embodiments, the second portion 530 of the hasp 500 may further comprise a square key plug 533. The square key plug 533 may be configured to be inserted into a square key hole 102 of a railcar door 101. When the square key plug 533 is disposed within the square key hole 102, the square key plug 533 may prevent the square key hole 102 from being engaged. In particular embodiments, the square key plug 533 may have a suitable size and shape in order to prevent the rotation of the square key hole 102. In some embodiments, the shape of the square key plug 533 may be chosen to have a similar cross section to that of the recess 105 of the square key hole 102. For example, the square key plug 533 may have a substantially square cross section as depicted in FIGS. 5A and 5B. Similarly, in some embodiments, the size of the square key plug 533 may be chosen based on the size of the recess 105 of the square key hole 102. For example, if both the recess 105 and the square key plug 533 have a square cross section, the square key plug 533 may be dimensioned to have a cross section having sides with length at least the length of the sides of the recess 105 cross section divided by the square root of two.

In particular embodiments, the square key plug 533 may have a shape different from a rectangular prism shape to better allow the square key plug 533 to enter and exit the recess 105 of the square key hole 102. For example, the portion of the square key plug 533 that would first enter the square key hole 102 may be rounded or tapered such that the edge does not catch against a portion of the square key hole 102. In some embodiments, the square key plug 533 may be smaller than the recess 105 of the square key hole 102. In some embodiments, this feature alone, or in addition to having a non-rectangular prism shape, may allow the square key plug 533 to enter and exit the recess 105 more easily.

Even though the square key plug 533 may be smaller than the recess 105 of the square key hole 102, it may be desirable to maximize the portion of the recess 105 filled by the square key plug 533 when it is inserted. The square key plug 533 may prevent the rotation of the square key hole 102 by holding a fixed position via the affixed first portion 520 of the hasp 500 coupled to the hinge 510 and the second portion 530 of the hasp 500 and pushing against the sides of the recess 105 of the square key hole 102 opposing the rotation. The more of the recess 105 filled by the square key plug 533 the less the square key hole 102 may rotate when the square key plug 533 is inserted, and the less space in which a person may tamper with or attempt to remove the square key plug 533 or any other portion of the hasp 500.

In some embodiments, the second portion 530 of the hasp 500 and the square key plug 533 may be provided contemporaneously. For example, the second portion 530 of the hasp 500 may be formed out of a single piece of material, such as by a process of casting or sheet metal folding, for example. In other embodiments, the square key plug 533 may be formed separately from the other portions of the second portion 530 and then affixed to the second portion 530.

Different railcars may have different positions of the square key hole 102 in relation to other portions of the railcar 100. Different square key hole 102 positions may require a different orientation or placement of the hasp 500. The different entry angles as a result of the different orientations or placements may require a different shape or size of the square key plug 533 as part of the second portion 532 in order to be inserted into the square key hole 102 via the articulation of the second portion 532 around the hinge 510. As such, different methods of forming the second portion 530 comprising a square key plug 533 may be used according to different needs of the installation onto the railcar. In some embodiments, the installer may change the size and shape of the square key plug 533 which is already affixed to the second portion 530 of the hasp 500.

Figure 5C:
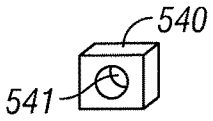

FIG. 5C depicts an example staple in perspective view, according to some embodiments. The staple 540 may be affixed to a portion of a railcar 100. The staple 540 may be affixed in a position such the first hole 534 defined in the second portion 530 of the hasp 500 aligns with the staple 540. As with the first portion 520 of the hasp 500, the staple 540 may be affixed to the railcar 100 in any number of ways. For example, the staple 540 may be affixed by a number of fastening means, including, but not limited to, welding, riveting, gluing, cementing, crimping, and securing by a bolt and nut. The means to affix the staple 540 to the railcar may be the same or different than the means to affix the first portion 520 of the hasp 500 to the railcar. For example, both the first portion 520 of the hasp 500 and the staple 540 may be welded to portions of the railcar 100.

The staple 540 may have a shape and size such that the staple 540 may pass through the first hole 534 in the second portion 530 of the hasp 500. In some embodiments, the shape of at least some cross section of the staple 540 may match the first hole 534. For example, as depicted in FIGS. 5A-5C, both the first hole 534 and the staple have a rectangular cross section. In other embodiments, the staple 540 may have a cross section having a different shape than the first hole 534.

In particular embodiments, the size of the staple 540 is smaller than the first hole 534. Since a portion of the staple 540 may pass through into the first hole 534 as a consequence of the articulation of the second portion 530 of the hasp 500 around the hinge, the staple 540 is passes through the first hole 534 at an angle. As such, the first hole 534 having a larger size than the staple 540 may enable the hasp 500 to easily be disposed over a portion of the staple 540. If the staple 540 has a cross-section larger than the first hole 534 in the second portion 530 of the hasp 500, the hasp 500 may be prevented from being positioned such that the staple 540 is disposed through the first hole 534.

The staple 540 may also define a staple hole 541. The staple hole 541 may be configured to allow a portion of a locking mechanism to be disposed through the staple hole 541. For example, the staple hole 541 may be defined in a middle portion of the staple 540 with dimension and shape to receive a bolt portion of a bolt seal or a portion of a shackle of a padlock.

In some embodiments, the staple 540 may define the staple hole 541 once affixed to the railcar 100. For example, the staple 540 may be U-shaped such that when the ends of the U-shaped staple are affixed to the railcar 100, the staple 540 defines a staple hole 541. In such embodiments, a locking mechanism may be disposed through the staple hole 541 defined by the staple 540 in relation to the portion of the railcar 100 to which it is affixed.

Figure 6A:
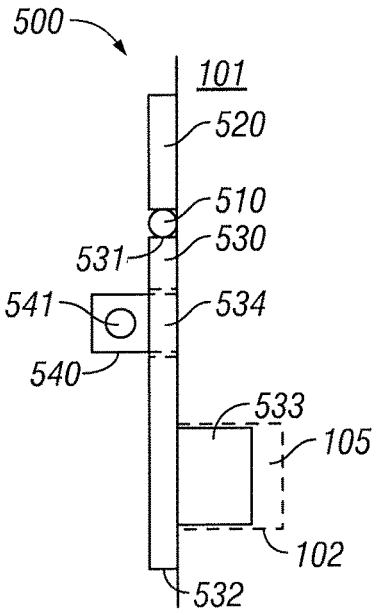
FIG. 6A is a schematic drawing in sectional elevation of an example hasp and staple affixed to a railcar end door in a first position, according to a particular embodiment.

FIG. 6A is a schematic drawing in sectional elevation of an example hasp and staple affixed to a railcar end door in a first position, according to a particular embodiment. In the depicted embodiments, the first portion 520 is affixed such that the hinge 510 is disposed between the first portion 520 and the square key hole. In such a configuration, the second portion 530 may be disposed substantially flat against the railcar 100 with the square key plug 533 disposed within the recess 105 of the square key hole 102. These particular embodiments may provide the advantage of minimizing the profile of the hasp 500 against the side of the railcar 100, reducing potential wind resistance and the chance of damaging collisions with the hasp 500. In addition, the orientation in the illustrated embodiments may reduce the size of the staple 540 necessary to provide an accessible staple hole 541 after the staple 540 has be disposed through the first hole 534 in the second portion 530 of the hasp 500.

In other embodiments, the first portion 520 may be affixed to the railcar 100 such that the hinge 510 is opposite the side closest to the square key hole 102. Such embodiments may have a larger profile since at least a part of the second portion 530 would be disposed next to the first portion 520 and not the railcar 100 when the square key plug 533 is disposed within the square key hole 102. Such a configuration, however, may provide the advantage of having a more generous entry angle for the insertion of the square key plug 533 and covering the first portion 520 when closed. In some embodiments, the first portion 520 may be affixed to the railcar 100 by means which may be undone if one has access to the exterior facing side of the first portion. For example, the first portion 520 may be affixed by screws or nuts which can be removed. In those cases, if the second portion 530 covers the first portion 520, only a person able to open the hasp 500 may remove them.

As discussed above, in some embodiments, the hinge 510 may allow the second portion 530 of the hasp 500 to articulate about an axis of the hinge 510, before and after the first portion 510 has been affixed to the railcar 100. The articulation of the second portion 530 allows the hasp 500 to be in at least two positions: an open position and a closed position.

In the particular embodiment shown in FIG. 6A, the hasp 500 is positioned in a closed position. In the closed position, the square key plug 533 is disposed within the recess 105 of the square key hole 102 and the staple 540 is disposed through the first hole 534 of the second portion 530 such that the staple hole 541 is accessible. In the closed position, because the square key plug 533 is inserted within the square key hole 102, the square key hole 102 may not be engaged. First, the second portion 530 covers the square key hole 102, at least partially, preventing a square key 400 from being inserted into the square key hole 102. Second, the inserted square key plug 533 prevents the rotation of the square key hole 102 as discussed previously. As such, the hasp 500 in the closed position prevents the engagement of the square key hole 102, even if a person has access to the interior of the railcar 100.

Figure 6B:
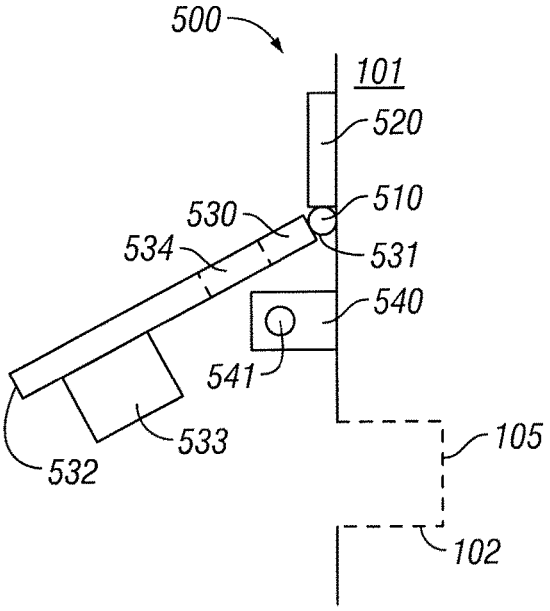
FIG. 6B is a schematic drawing in sectional elevation of an example hasp and staple affixed to a railcar end door in a second position, according to a particular embodiment.

FIG. 6B is a schematic drawing in sectional elevation of an example hasp and staple affixed to a railcar end door in a second position, according to a particular embodiment. The particular embodiment shown in FIG. 6B illustrates the hasp 500 positioned in an open position. An operator of the railcar may move the hasp 500 from the closed position to an open position by articulating the second portion 530 around the axis of the hinge 510, thereby removing the square key plug 533 from the square key hole 102. By removing the square key plug 533, the operator would have access to the square key hole 102. The operator may then engage the square key hole with a square key 400 in order to access the cargo within the railcar 100. In an open position, the staple 540 may still be partially disposed through the first hole 534 defined in the second portion 530.

In some embodiments, the hasp 500 may include means to maintain the hasp in an open position. Such means may comprise the force of gravity in embodiments where the first portion 510 is affixed on a portion of the railcar 100 below the square key hole 102. Means may also include an additional element which mechanically holds the second portion 530 away from the square key hole 102. For example, a clip coupled to the first portion 520 may operate to hold the second portion 530 up and away from square key hole 102 until a force is applied to disengage the clip from the second portion 530.

In the embodiments depicted in FIGS. 5A and 5B, the second portion 530 defines the first hole 534 between the first end 531 and the square key plug 533. In those embodiments, the staple 540 may be affixed on the railcar 100 between the portion of the railcar 100 where the first portion 520 of the hasp 500 will be affixed and the square key hole 102, as shown in FIGS. 6A and 6B. In other embodiments, the second portion 530 may define the first hole 534 between the second end 532 and the square key plug 533.

Different relative positions of the first hole 534 and the square key plug 533 on the second portion 530 of the hasp 500 may have different advantages. For example, defining the first hole 534 as shown in FIGS. 5A and 5B may allow easier entry of the square key plug 533 into the recess 105 of the square key hole 102. Because the square key plug 533 is positioned closer to the second end 532 and further away from the hinge 510, the angle of entry into the recess 105 is closer to perpendicular to the railcar 100.

In the case where first hole 534 is defined between the second end 532 and the square key plug, the hasp 500 may be held more securely in the closed position, preventing the engagement of the square key hole 102. For example, the first hole 534 being defined further away from the rotation point, i.e. the hinge 510, allows a locking mechanism to provide more counter-torque against a person opening the hasp 500. As demonstrated above, a person having skill in the art may choose the relative positions of the various elements of the hasp and/or staple in order to enhance the security of the square key hole based on desired qualities or circumstances.

Figure 7A:
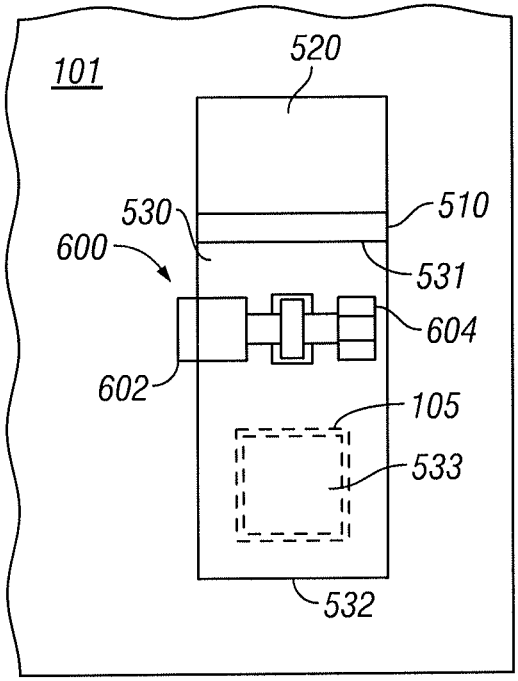
FIGS. 7A and 7B are schematic drawings, in front elevation and cross-section side view, respectively, of an example hasp and staple affixed to a railcar end door in a closed position with an example locking mechanism, according to a particular embodiment.
Figure 7B:
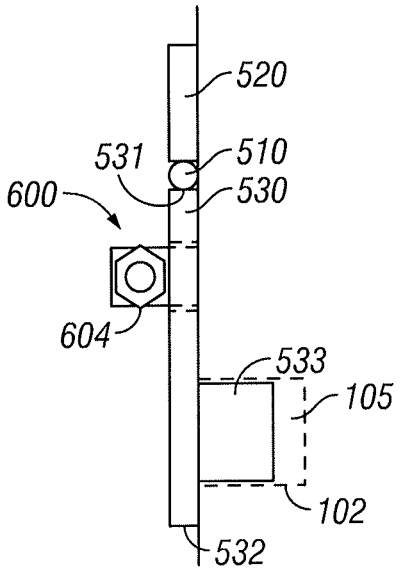

FIGS. 7A and 7B are schematic drawings, in front elevation and cross-section side view, respectively, of an example hasp and staple affixed to a railcar end door in a closed position with an example locking mechanism, according to a particular embodiment. The hasp 500 may be held in a closed position by a locking mechanism 600. A portion of the locking mechanism 600 may be disposed through the staple hole 541 such that the locking mechanism 600 prevents the second portion 530 of the hasp 500 from being articulated about the axis of the hinge 510 into an open position.

For example, in the particular embodiment illustrated in FIGS. 7A and 7B, the locking mechanism 600 is a bolt seal comprising a seal 602 and a bolt 604. In this embodiment, a portion of the bolt 604 is disposed through the staple hole 541 when the hasp 500 is in the closed position. The bolt 604 disposed through the staple hole 541 prevents the opening of the hasp 500 by providing a counter force against the second portion 530. The seal 602 helps retain the bolt 604 disposed through the staple hole 541. Because the seal 604 cannot be removed without a special tool, the locking mechanism 600 in conjunction with the hasp 500 and staple 540 protects the square key hole 102 from being engaged.

In other embodiments, other locking mechanisms 600 may be used to maintain the hasp 500 in a closed position. For example, in some embodiments, the locking mechanism 600 may be a padlock, wherein the shackle portion of the padlock is disposed through the staple hole 541. In such embodiments, only a person having a corresponding access key or code may be able to remove the locking mechanism 600 and open the hasp 500.

FIGS. 9A-9D illustrate an example variation of hasp 500. In particular embodiments, the apparatus may further comprise a second staple. In such embodiments, the second portion 530 of the hasp 500 may define a second hole through which a portion of the second staple may pass when the hasp 500 is in a closed position. A hasp having two staples disposed through two holes in the closed position may provide additional security. For example, the two staples may provide two places through which a locking mechanism 600 may be disposed. An operator may use two separate locking mechanisms which must be removed before accessing the square key hole 102, or alternatively, the operator may dispose two different portions of the same locking mechanism through the two staples in order to secure the hasp.

In particular embodiments comprising a second staple, the second portion 530 may define the two holes such that the square key plug 533 is affixed between them. For example, the square key plug 533 may be affixed to the middle of the second portion 530 and the two holes defined on either side, as illustrated in FIGS. 9A-9D. Put differently, the first hole may be defined between the first end 531, towards the hinge 510, and the square key plug 533 and the second hole may be defined between the second end 532, opposite of the first end 531, and the square key plug 533. The placement of the two holes, and the two staples when in the closed position, on either side of the square key plug 533 may enhance the restraint of the locking mechanism(s) of the hasp 500 in the closed position. For example, by separating the two staples, the operator may more easily install and remove the one or more locking mechanisms disposed through the staples. Additionally, the placement of a second staple away from the hinge 510 may increase the counter-torque needed to pry the hasp 500 open when restrained by a locking mechanism.

Figure 8:
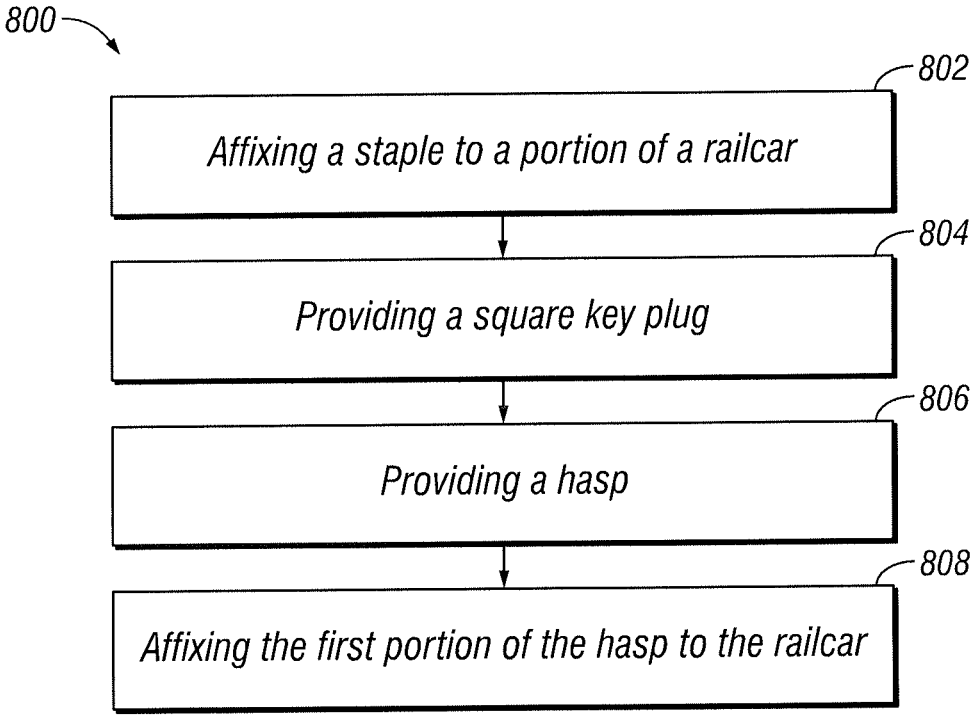
FIG. 8 is a flow diagram illustrating an example method of securing rail car doors, according to some embodiments.
Figure 9A:
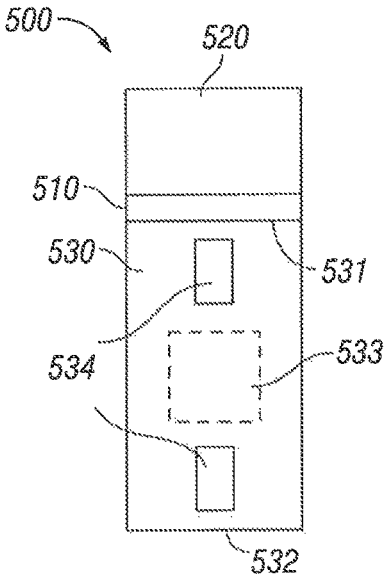
FIGS. 9A-9D are schematic drawings of an example hasp and staple for securing a square key hole with a second staple, according to a particular embodiment.
Figure 9B:
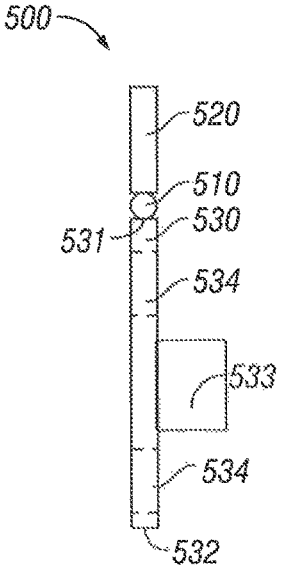
Figure 9C:
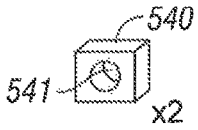
Figure 9C:
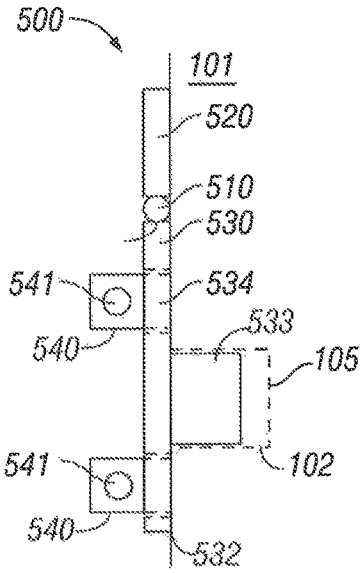
Figure 9D:
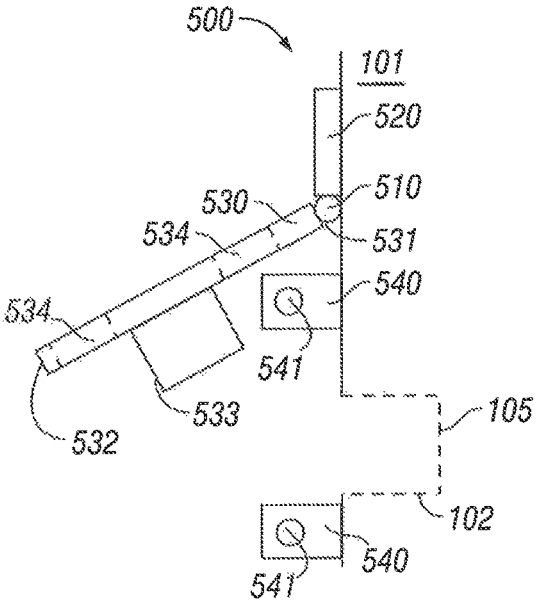

FIG. 8 is a flow diagram illustrating an example method of securing rail car doors, according to some embodiments. The steps of method 800 may provide additional security to the cargo on the railcar for at least some reasons as described in reference to FIGS. 1-7.

The method 800 may comprise a step 802 of affixing a staple 540 to a portion of a railcar 100. The affixed staple 540 may define a staple hole 541 through which a locking mechanism may be placed as discussed in reference to FIG. 5C.

The method 800 may further comprise a step 804 of providing a square key plug 533 configured to be inserted into a square key hole 102 of the railcar 100. 102 of the railcar 100. In particular embodiments, the provided square key plugs 533 have predetermined dimensions based on a standard size of square key holes on railcars. Having standard sized square key plugs may allow for the efficient manufacture and installation of an apparatus.

In particular embodiments, providing a square key plug 533 may include shaping the square key plug 533 based on the square key hole 102 size and shape and the relative position of the hinge 510 and the square key hole 102. For example, the angle of entry of the square key plug 533 may require curved portion in order to effectively enter and exit the square key hole 102, as discussed in reference to FIGS. 5A and 5B.

The method 800 may further comprise a step 806 of providing a hasp 500. The provided hasp 500 in step 806 may comprise a hinge 510, a first portion 510, and a second portion 520. The first portion 520 may be pivotally coupled to the hinge 510. The second portion 530 may comprise a first end 531 pivotally coupled to the hinge 510 and a second end 532. The second portion 530 of the hasp 500 may define a first hole 534 through which a portion of the staple 540 affixed in step 802 may be disposed. In some embodiments, the provided square key plug in step 804 is affixed to the second portion 530 of the provided hasp 500. Various embodiments of step 806 may include some, all, or none of the features described earlier in reference to the hasp 500 in FIGS. 5-7.

The method 800 may further comprise a step 808 of affixing the first portion 520 of the hasp 500 to the railcar 100. The first portion 520 may be affixed such that affixed staple 540 may be disposed through the first hole 534 defined in the second portion 530 of the hasp 500 and the affixed square key plug 533 may be disposed within the square key hole 102 when the second portion 530 is articulated about the hinge 510 into the closed position. In particular embodiments, the first portion 520 of the hasp 500 is affixed to the railcar 100 above the square key hole 102. By affixing the first portion 530 above the square key hole 102, gravity may aid in retaining the hasp 500 in a closed position or moving the hasp 500 from an open position to a closed position without operator intervention.

In particular embodiments, each of step 802 and step 808 may comprise welding the staple 540 and the first portion 520 of the hasp 500 to a portion of the railcar, respectively. For example, one or more of the staple 540 and the first portion 530 of the hasp 500 may be welded to a portion of the railcar in order to secure it strongly.

The alignment of these elements may require individual installation considerations. In some embodiments, a standard configuration may be determined to suit particular orientations and positions for installations. Having a standard hasp, staple, and installation position and orientation may decrease the time to install the security measure and provide uniformity in operation and maintenance. In particular embodiments, the method 800 may be tailored individually to a particular railcar square key hole 102. Allowing the installer to tailor the security measure to the particular circumstances of the railcar may provide the most secure installation of the hasp and staple combination to protect the cargo. Additionally, even using standard equipment and installation specifications, installers may still want to change or modify the position, shape, size, or any other aspect of the security measure in order to make the security measure compatible with the recipient railcar. For example, even using standard components, small deviations, either in manufacture or due to neglect or wear and tear, may prevent the proper alignment of the square key plug 533 into the square key hole 102 or the staple 540 through the first hole 534 defined in the second portion 530 of the hasp 500. The installer may modify the provided standard security measure in order to install it onto the railcar.

The steps described above in method 800 have been presented in an order to best explain a particular embodiment. The steps of method 800 may be completed in any order. For example, an installer may want to first affix the first portion 520 of the hasp 500 to the railcar 100 in step 810 before affixing the staple 540 in step 802.

In some embodiments, additional steps may be added to method 800. In particular embodiments, the method 800 may further comprise affixing a second staple to a portion of the railcar. For example, the provided hasp 500 may define a second hole through which the second staple may pass when the hasp 500 is in a closed position. The addition of a second staple and corresponding hasp hole may increase the security of the hasp and staple combination. While requiring an additional installation step, the installation of the second staple may provide an additional hole through which a second locking mechanism may be disposed. By providing two locking mechanisms which hold the hasp 500 in a closed position, an unauthorized person may be further deterred from attempting to gain access to the square key hole 102 and the cargo within the railcar 100.

In particular embodiments, the square key plug 533 is affixed to a portion of the second portion 530 of the hasp 500 between the first hole 534 and the second hole. As discussed above, placing the square key plug 533 between the two holes defined in the second portion 530 may provide several advantages such as providing space between the two staples to enable easy placement and removal of locking mechanisms or providing a more secure hold in the closed position.

Modifications, additions, or omissions may be made to the systems and apparatuses disclosed herein without departing from the scope of the invention. The components of the systems and apparatuses may be integrated or separated. Moreover, the operations of the systems and apparatuses may be performed by more, fewer, or other components.

Although embodiments of the present disclosure and their advantages have been described in detail, it should be understood that various changes, substitutions and alternations can be made herein without departing from the spirit and scope of the invention as defined by the claims below.

The example embodiments described herein may be included with a new railcar or new railcar doors. In some embodiments, the components described herein may be retrofitted to existing railcars or railcar doors.

Some embodiments of the present disclosure may provide numerous technical advantages. For example, in particular embodiments, the hasp may be affixed to a portion of the railcar such that the hasp may close, plugging the square key hole, due to the force of gravity. In such cases, when the locking mechanism is removed from the staple and hasp, the hasp does not unintentionally fall open. In some embodiments, the staple and hasp may be affixed in another orientation according to the requirements of the operators or installers. For example, the railcar to be secured may have a square key hole in a position such that the hasp may only be oriented in a limited number directions. As another example, the railcar may only have certain portions suitable to affix the staple and/or hasp, requiring a particular orientation or one of a few limited orientations.

In particular embodiments, the hasp may have more than one hole corresponding to more than one staple. According to those embodiments, the security may be increased by having a second hole and a second staple through which a second locking mechanism may be disposed holding the hasp in the closed position. Including an additional locking mechanism may increase the time required for an unauthorized person to open the hasp to gain access to the square key hole.

In particular embodiments, the square key plug inserted into the square key hole when the hasp is in the closed position may prevent the engagement of square key hole from both the exterior and interior of the railcar. The square key plug may prevent the rotation of the square key hole since the hasp, to which the square key plug is attached, cannot rotate and is held in the closed position by a locking mechanism. Thus, even a person who may gain access to the interior of the railcar may still be prevented from unloading any cargo in the railcar since the hasp would prevent the engagement of the square key hole.

Some embodiments may benefit from some, none, or all of these advantages. Other technical advantages may be readily ascertained by one of ordinary skill in the art.

The invention claimed is:

1. An apparatus for securing railcar doors, comprising:

a staple affixed to a portion of a railcar, wherein the staple defines a staple hole; and a hasp, comprising:

a hinge;

a first portion pivotally coupled to the hinge, the first portion affixed to the railcar; and a second portion, comprising a first end and a second end, wherein:

the first end of the second portion is pivotally coupled to the hinge;

the second end of the second portion is opposite the first end;

the second portion of the hasp comprises a square key plug configured to be inserted into a square key hole of a railcar door, wherein the square key hole and square key plug each have a square cross-section, the square cross-section of the square key plug being smaller than the square cross-section of the square key hole;

wherein:

the second portion of the hasp defines a first hole through which a portion of the staple may pass when the hasp is in a closed position; and a side length of the square cross-section of the square key hole is less than $\sqrt{2}$ times bigger than a side length of the square cross-section of the square key plug.

2. The apparatus of claim 1, further comprising a locking mechanism configured to be placed through the defined staple hole when the hasp is in the closed position to prevent the hasp from opening.

3. The apparatus of claim 2, wherein the locking mechanism is one of a bolt seal and a padlock.

4. The apparatus of claim 1, wherein the staple and the first portion of the hasp are welded to a portion of a railcar.

5. The apparatus of claim 1, wherein the second portion of the hasp defines the first hole between the first end of the second portion of the hasp and the square key plug.

6. The apparatus of claim 1, wherein the second portion of the hasp defines the first hole between the square key plug and the second end of the second portion of the hasp.

7. The apparatus of claim l:

further comprising a second staple; and wherein the second portion of the hasp defines a second hole through which a portion of the second staple may pass when the hasp in in a closed position.

8. The apparatus of claim 7, wherein:

the second portion of the hasp defines the first hole between the first end of the second portion of the hasp and the square key plug; and the second portion of the hasp defines the second hole between the square key plug and the second end of the second portion of the hasp.

9. A method for securing railcar doors, comprising affixing a staple to a portion of a railcar;

providing a square key plug configured to be inserted into a square key hole of the railcar, wherein the square key hole and square key plug each have a square cross-section, the square cross-section of the square key plug being smaller that the square cross-section of the square key hole;

providing a hasp, wherein the hasp comprises:

a hinge;

a first portion pivotally coupled to the hinge;

a second portion, comprising:

first end pivotally coupled to the hinge;

a second end;

wherein the second portion of the hasp defines a first hole through which a portion of the staple may be disposed;

wherein the provided square key plug is affixed to the second portion of the hasp; and affixing the first portion of the hasp to the railcar such that when the hasp is closed, the square key plug is inserted within the square key hole of the railcar and a portion of the staple is disposed through the first hole defined in the second portion of the hasp;

wherein a side length of the square cross-section of the square key home is less than $\sqrt{2}$ times bigger than a side length og the square cross-section of the square key plug.

10. The method of claim 9, wherein the first portion of the hasp is affixed to the railcar above the square key hole of the railcar.

11. The method of claim 9, wherein affixing the staple and the first portion of the hasp comprises welding each of the staple and the first portion of the hasp to a portion of the railcar.

12. The method of claim 9, wherein the square key plug is affixed to the second portion of the hasp between the second end of the second portion of the hasp and the hole defined by the second portion of the hasp.

13. The method of claim 9, wherein the square key plug is affixed to the second portion of the hasp between the first end of the second portion of the hasp and the hole defined by the second portion of the hasp.

14. The method of claim 9:

further comprising affixing a second staple to a portion of a railcar; and wherein the second portion of the hasp defines a second hole through which a portion of the second staple may pass when the hasp in in a closed position.

15. The method of claim 14, wherein the square key plug is affixed to a portion of the second portion of the hasp between the first hole and the second hole.

16. An apparatus, comprising:

at least one railcar door, the at least one railcar door comprising a locking mechanism, the locking mechanism comprising a square key hole, the locking mechanism coupled to at least one locking pin;

a staple affixed to a portion of the at least one railcar door, wherein the staple defines a staple hole; and a hasp, comprising:

a hinge;

a first portion pivotally coupled to the hinge, the first portion affixed to the railcar; and a second portion, comprising a first end and a second end, wherein:

the first end of the second portion is pivotally coupled to the hinge; the second end of the second portion is opposite the first end; and the second portion of the hasp comprises a square key plug configured to be inserted into the square key hole afire at least one railcar door, wherein the square key hole and square plug each have a square cross-section, the square cross-section of the square key plug being smaller than the square cross-section of the square key hole;

wherein:

the second portion of the hasp defines a first hole through which a portion of the staple may pass when the hasp is in a closed position: and a side length of the square cross-section of the square key hole is less than √2 times bigger than a side length og the square cross-section of the square key plug.

17. The apparatus of claim 16, further comprising a locking mechanism configured to be placed through the defined staple hole when the hasp is in the closed position to prevent the hasp from opening.

18. The apparatus of claim 17, wherein the locking mechanism is one of a bolt seal and a padlock.

19. The apparatus of claim 16, wherein the staple and the first portion of the hasp are welded to portions of the at least one railcar door.

20. The apparatus of claim 16, wherein the second portion of the hasp defines the hole between the first end of the second portion of the hasp and the square key plug.

* * * * *